United States Patent [19]

Stoeffler et al.

[11] Patent Number: 4,823,946

[45] Date of Patent: Apr. 25, 1989

[54] TWO-COMPARTMENT CONTAINER

[75] Inventors: Albert Stoeffler; Dietholf Mehl, both of Duesseldorf; Hans Schneider, Schwalmtal, all of Fed. Rep. of Germany

[73] Assignee: Henkel Kommanditgesellschaft auf Aktien, Duesseldorf, Fed. Rep. of Germany

[21] Appl. No.: 216,469

[22] Filed: Jul. 7, 1988

[30] Foreign Application Priority Data

Jul. 7, 1987 [DE] Fed. Rep. of Germany ..... 3722371

[51] Int. Cl.[4] ..... B65D 25/08

[52] U.S. Cl. ..... 206/221; 215/6; 215/DIG. 8

[58] Field of Search ..... 206/219, 221; 215/6, 215/DIG. 8

[56] References Cited

U.S. PATENT DOCUMENTS 3,443,726 5/1969 Muller et al. ..... 222/80
4,693,366 9/1987 Goncalves ..... 215/DIG. 8

FOREIGN PATENT DOCUMENTS 3528525 2/1987 Fed. Rep. of Germany .
611863 10/1960 Italy ..... 215/6
628274 11/1961 Italy ..... 215/6
1436648 5/1976 United Kingdom ..... 215/DIG. 8

*Primary Examiner*—William Price
*Attorney, Agent, or Firm*—Ernest G. Szoke; Wayne C. Jaeschke; Real J. Grandmaison

[57] ABSTRACT

Combinable bottle assembly (1,6) consisting of two separately fillable bottles designed to be fitted together one above the other, can be formed inexpensively of plastic, filled and stored separately from and independently of one another and can readily be connected and tightly combined with one another to form a two-compartment container convertible to a one compartment container.

The floor or bottom wall (12) of the upper bottle (1) is formed as a separate cylinder element (3) having an annular connecting plate (13) which connects a skirt wall (14) of the cylinder element to the wall (15) of a central nozzle (9) arranged concentrically therein, forming a throughflow passage (16) which is closed by a stopper (10). The lower bottle (6) comprises an elongate neck having an external screwthread (33) which is engagable with an internal thread on the elongate nozzle to permit the second bottle to be screwed into the nozzle to a connecting position to dislodge the stopper and open the containers to each other.

10 Claims, 2 Drawing Sheets

TWO-COMPARTMENT CONTAINER

BACKGROUND OF THE INVENTION

1. Field of the Invention

This invention relates to a device or assembly of two bottles combinable with one another to form a two-compartment container for accommodating two isolated components intended to be mixed just prior to use to produce a ready-to-use, liquid or paste-form preparation before removal from the container.

2. Statement of Related Art In the preparation of ready-to-use hair-dye emulsions, two components, namely the liquid or paste-form dye component and a paste-form or liquid oxidizing agent, generally hydrogen peroxide, must be isolated from each other before being mixed to form a ready-to-use preparation. For this purpose, West German Published Application DE 35 28 525 describes a unitary two-compartment container consisting of an upper container section for accommodating the paste-form dye component, and having a throughflow passage in the base which is closed to a second container section inserted therein from below by a stopper sealing the second container section. In use, the second container section has a plunger which is supported to be pushed vertically upwards, adjacent the throughflow passage to lift the stopper from the second container and open the throughflow passage, so that the two components respectively present in the two container sections are able to mix with one another. This two-compartment container has the disadvantage that it can only be stored and handled as a unit of the two combined or assembled container sections. This is because the upper container section is only closed by insertion of the lower bottle or container section having the stopper thereon.

The same disadvantage applies to the two-compartment container disclosed in U.S. Pat. No. 3,443,726. This container consists of two container sections which are threadably engaged and are designed to be screwed into one another, the throughflow passage between the two containers being closed by a metal stopper which has a scored center portion which breaks away when the container sections are fully screwed. This two-compartment container also can only be handled as a unit since it has a single stopper.

DESCRIPTION OF THE DRAWINGS

THE DRAWINGS

Figure 3:
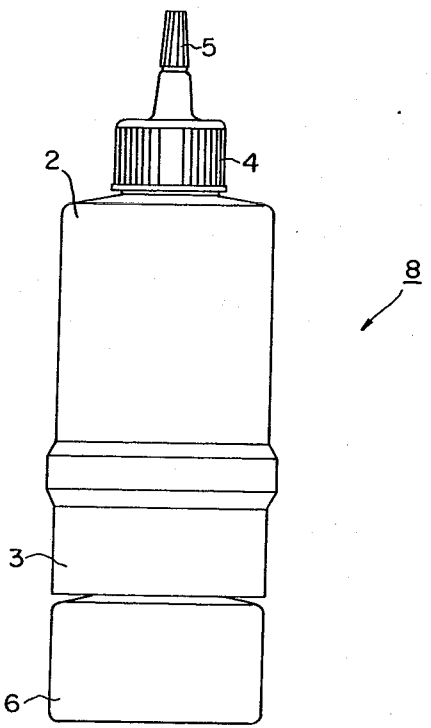
Figure 1:
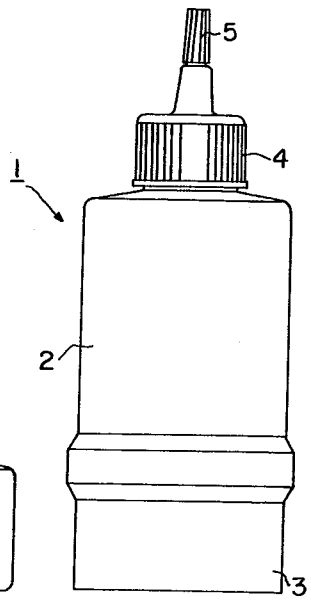
Figure 2:
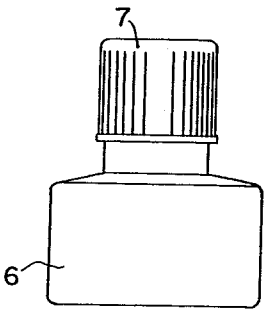
Figure 4:
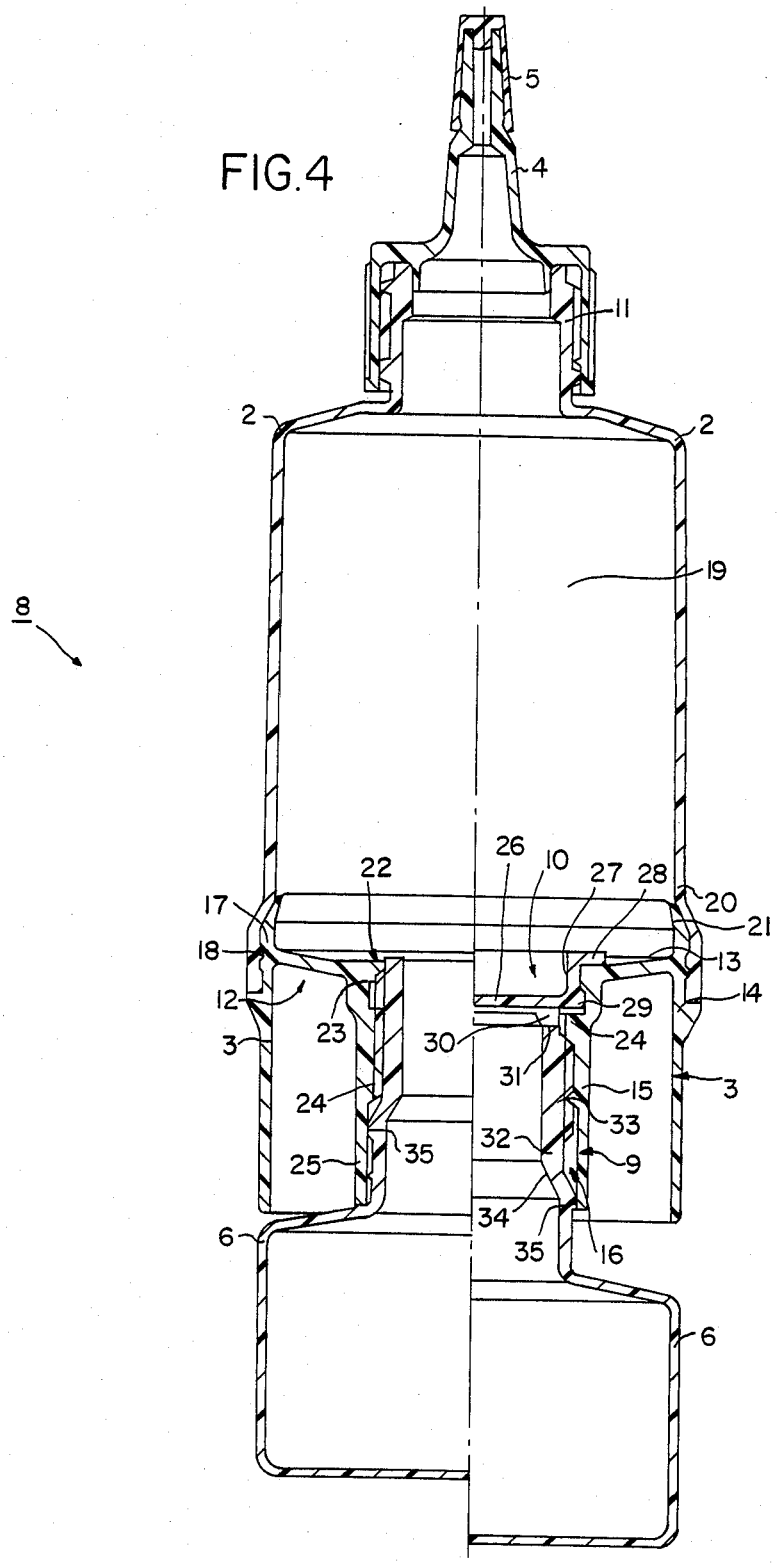

FIG. 1 is an elevation of an upper bottle with a cylinder skirt element secured to its base according to an embodiment of the present invention;

FIG. 2 is an elevation of a lower bottle sealed by a removable cap, suitable for use in association with the bottle of FIG. 1;

FIG. 3 is a two-compartment container comprising the upper and lower bottles of FIGS. 1 and 2 tightened together to open communication between their compartments, the cap of the lower bottle having first been removed, and FIG. 4 is a section through the two-compartment, container of FIG. 3 illustrating relative positions before and after the stopper is dislodged.

DESCRIPTION OF THE INVENTION

The present invention relates to improved two-compartment containers of the aforementioned type comprising individual bottles which can be inexpensively made of plastic, can be filled and sealed independently of one another, can be stored, handled and supplied separately from and independently of one another as filled individual components and, without major effort, can be assembled with one another to form a two-compartment container which is convertible into a container in which the two compartments are opened to each other while maintaining the container sealed against leakage.

Such containers are produced in accordance with this invention by forming an upper bottle of two separate but connectable sections, namely an upper cylindrical wall section having a lower flange surrounding an open bottom, and a cylinder skirt element having an annular plate which connects the outer wall of the cylinder skirt element to the wall of a cylindrical nozzle arranged concentrically therein, forming a throughflow passage having an opening which is closed by a stopper. The outer wall of the cylinder skirt element is designed to sealingly engage the cylindrical wall of the upper bottle section, and the opening of the nozzle within the compartment of the bottle comprises a sealing lip within which the stopper is sealingly but removably engaged to form a sealed bottom or floor and provide a sealed upper bottle. The lower bottle comprises an elongate neck having an external screwthread and a neck wall region projecting radially outwards and terminating in an annular collar which, in the connecting position forming the two-compartment container, bears sealingly against the inside wall of the nozzle. Through this construction, the upper and lower bottles may be separately filled, the upper bottle subsequently being closed by the cylinder skirt element provided with the stopper, and the lower bottle being closed by a standard screwthreaded closure cap. In this way, the two bottles can be handled independently of and separately from one another and, in particular, may be stored independently of one another. For use, the screw cap is removed from the lower bottle and the lower bottle neck is screwed into the upper bottle nozzle, the stopper automatically being displaced into the upper bottle compartment by engagement with the rim portion of the neck of the lower bottle.

In another embodiment of the invention, which is designed to ensure secure fastening of the stopper in the nozzle of the upper bottle and problem-free accommodation of the rim of the neck of the lower bottle within the nozzle, at the junction with the annular connecting plate, the nozzle comprises a substantially cylindrical outlet opening having an annular stopper-engaging collar or bead projecting radially inwards, adjoined by a cylindrical screwthreaded portion projecting radially further inwards into the throughflow passage of the nozzle and, in the lower region of the nozzle spaced from the upper stopper-engaging part, a smooth cylindrical neck wall portion with a throughflow cross-section which is larger in diameter than the screwthreaded portion.

According to another embodiment of the invention, the surface of the inverted stopper facing the compartment of the upper bottle comprises an annular radially projecting end flange bearing against the inside floor of the connector plate, adjacent the nozzle opening, and an annular radially projecting outward collar or bead on its cylindrical side wall which engages below the inward collar of the nozzle. In the region of its dome or baseplate, the stopper has a projection or a pin which projects axially downwards from the baseplate and which is engaged by the rim of the opening portion or neck of the lower bottle when the lower bottle is screwed in. This construction of the stopper ensures that it is securely and sealingly held within the nozzle opening, and the projecting pin creates an excellent point of contact between the stopper and the rim of the opening portion or neck of the lower bottle, which facilitates the levering out and displacement of the stopper.

Another practical embodiment of the invention involves forming the upper part of the upper bottle and the stopper of a flexible plastic, more especially polyethylene, and forming the separate cylinder skirt element of a rigid plastic, more especially polypropylene, and forming the lower bottle of a rigid plastic substantially impermeable of oxygen, more especially polyvinyl chloride (PVC) or Barex.

Finally, another embodiment of the invention involves injection molding the cylinder skirt element with an integral sealing lip and nozzle.

DESCRIPTION OF THE DRAWINGS

FIG. 1 of the drawings illustrates an upper bottle 1 consisting of an upper cylindrical wall section 2 and a separate cylinder skirt element 3 forming the bottom wall or floor of the upper bottle 1. At its head, the upper bottle 1 is closed by a two-piece closure formed by a screw-on applicator 4 and a closure cap 5 which closes the applicator 4. FIG. 2 illustrates a lower bottle 6 which is closed by a screw cap 7. To form the two-compartment container 8 of FIG. 3, the screw cap 7 is removed from the lower bottle 6 and the lower bottle 6 is screwed from beneath into the cylinder skirt element 3 of the bottle 1. The engagement details are shown in FIG. 4 which is a section through the two-compartment container 8. The engagement position in which the neck of the lower bottle 6 is screwed a portion of the way into the nozzle 9, so that the stopper 10 is still in place, is shown on the right hand side of FIG. 4, and the communication position in which the neck of the lower bottle 6 is fully screwed in and the stopper 10 is removed is shown on the left-hand side. The upper part 2 of the upper bottle 1 is a substantially cylindrical side wall 20, an upper end of which tapers in to an opening or mouth portion 11 which is closed by the two-piece closure 4,5, and a lower end of which comprises an outwardly tapered flange wall surrounding an open bottom. The lower part, or bottom of the upper bottle 1 is closed by the cylinder skirt element 3 which is snapped on to form the floor or bottom wall 12 of the upper compartment 19. The bottom wall 12 is formed in the cylinder skirt element 3 as an annular connecting plate 13 which connects the outer cylindrical wall 14 of the cylinder skirt element 3 to the wall 15 of the nozzle 9 which is arranged concentrically in the cylinder element 3 and comprising the throughflow passage 16. The outside surface of wall 14, tapered inwardly adjacent its connection to the connecting plate 13, comprises detent means 17, such as an annular bead which engages within an annular recess below annular detent means 18 formed correspondingly in the inside of the flange wall adjacent the lower end of the upper bottle 1. The cylindrical wall 14 of the cylinder skirt element 3 tapers up to a sealing lip 21 which projects into the interior 19 of the bottle 1 and which bears internally against the wall 20 of the upper section 2 to provide sealing engagement. At its junction with the annular connecting plate 13, the nozzle 9 is in the form of a substantially cylindrical central outlet opening 22 with an annular collar 23 projecting radially inwards therein. Adjoining the collar 23, the nozzle 9 comprises a cylindrical screwthreaded portion 24 projecting radially inwards into the throughflow passage 16 inwardly from the outlet opening 22 and, in its lower region remote from the upper opening 22, terminates in a smooth cylindrical wall portion 25 which again comprises a wider throughflow cross-section of the throughflow passage 16 than the screwthreaded portion 24.

The cap-like stopper 10 consists of a dome or baseplate 26, a narrow cylindrical sidewall 27 and an annular end plate 28 which projects radially outwards and rests against the inside of the bottom wall 12 or rather the connecting plate 13. In the region of its cylindrical wall 27, the stopper 10 comprises an annular bead or collar 29 which projects radially outwards and which, in the closed position, engages behind or below the inward collar 23 of the nozzle 9 to seal opening 22. A pin 30 projects axially downwards from the baseplate 26 of the stopper for engagement by the rim 31 of the mouth portion or neck 32 of the lower bottle 6 as the latter is screwed in to the full extent to pivot and then level the stopper out of engagement within the opening.

Integrally formed on the neck 32 of the lower bottle 6 is an external screwthread 33 which, in the connecting position, engages the internal thread 24 of the nozzle 9. In the base of the neck or opening portion 32 of the lower bottle 6, the wall portion 34 tapers radially outwards to form an annular collar 35. In the connecting position forming the two-compartment container, the collar 35 bears sealingly against the inside of the smooth cylindrical wall portion 25 of the nozzle 9, as shown in FIG. 4.

The upper section 2 of the upper bottle 1 and the stopper 10 preferably are made of a flexible plastic, more especially polyethylene, the separate cylinder skirt element 3 of a rigid plastic, more especially polypropylene, and the lower bottle 6 of a rigid plastic substantially impermeable to oxygen, more especially polyvinyl chloride (PVC) or Barex. The bottle 6 may also be made by co-extrusion and thus rendered impermeable to oxygen.

The sealing lip 21 is integrally injection molded with the wall 14 of the cylinder element 3.

For use, the upper bottle 1 and the lower bottle 6 are first separately filled and then kept separate, with cap 7 on bottle 6, until they are to be assembled to form the two-compartment container.

For filling, the upper section 2 of bottle is first provided with the applicator 4 and closed with the cap 5. The hair-dye component or other fluid is then introduced into the upper section 2 in the upside-down position. The upper section 2 is then closed by snapping on the cylinder skirt element 3 into which the stopper 10 has been inserted beforehand. The lower bottle 6 is independently filled with fluid such as liquid oxidizing agent, preferably hydrogen peroxide, and closed with the screw cap 7. The upper bottle 1 and the lower bottle 6 may then be marketed either as a single item or separately as individual packs.

To form the two-compartment container 8, the screw cap 7 is removed from the bottle 6 and the bottle 6 is screwed into the throughflow passage 16 of nozzle 9 of bottle 1.

The two compartment container 8 is converted to a one compartment container by screwing bottle 6 into nozzle 9 as far as possible, causing stopper 10 to be displaced. In another method of filling, the upper section 2 of bottle 1 is supplied already assembled with the cylinder skirt element 3 and the stopper 10 in engagement. Hydrogen superoxide is introduced through the opening or mouth 11 and then mouth 11 is closed with the applicator 4 and closure cap 5. The bottle 6 is separately filled with the dye component.

It is to be understood that the above described embodiments of the invention are illustrative only and that modifications throughout may occur to those skilled in the art.

We claim:

1. An assembly of bottles which are designed to be individually filled and stored with different fluids which are intended to be mixed at the time of use, said bottles being connectable to each other in a first engagement position, in which their compartments remain isolated, and in a second communication position, in which their compartments are open to each other, comprising a first bottle having a housing forming a first compartment, comprising a top wall having a dispensing cover, a cylindrical side wall terminating in a cylindrical flange element surrounding an open bottom, and an attachable floor wall comprising a cylindrical skirt element having a cylindrical outer wall the top of which is attachable to the base flange of the side wall to form an annular base wall having a central opening therein and having an elongate cylindrical nozzle depending from said opening and carrying a screw thread on the interior surface thereof, a stopper within the compartment of said first bottle and sealingly engaged within said central opening, engagement means on the base flange of the side wall of the container and on the cylindrical outer wall of the skirt element for enabling the skirt element to be pushed up into sealing engagement with the side wall of the first container to form the floor thereof, and engagement means on the inside of the cylindrical nozzle, adjacent said opening, and on the outside of the stopper for providing sealing engagement of said stopper within said opening, and a second bottle having a housing forming a second compartment, said bottle having an elongate cylindrical neck having an annular top rim, and carrying a screw thread on the exterior thereof, which screw thread is engagable by a sealing cap to seal said second container and is also engagable, when said cap is removed, with the interior screw thread of the nozzle of the first container, whereby the neck of the second container can be screwed into said nozzle to a first engagement position, in which the bottles are connected to each other but the stopper remains engaged to isolate the compartments of said containers, and to a second communication position, in which the rim of the neck of the second container engages and forces the stopper out of sealing engagement with the opening to permit mixing of fluids which may be present in the compartments of the two containers.

2. An assembly according to claim 1 in which the cylindrical outer wall of said skirt element has a length at least equal to the length of said nozzle and a diameter substantially equal to that of the side wall of the first container.

3. An assembly according to claim 1 in which the top portion of said nozzle, adjacent said opening, comprises an annular bead which projects radially inwardly, and said stopper has a narrow cylindrical wall having an annular outer groove which receives said bead to provide the said engagement means therebetween.

4. An assembly according to claim 1 in which the cylindrical base flange of the side wall of the first container is tapered outwardly from said side wall and contains at least one annular groove, and the top of the cylindrical outer wall of the skirt element is tapered inwardly and contains at least one annular bead on the outer surface thereof which is receivable within said annular groove to provide said engagement means therebetween.

5. An assembly according to claim 1 in which the lower end of the inside wall of said nozzle has a smooth portion below said screw thread, and the lower end of the neck of the second bottle has an annular projection, below the screw thread thereof, which sealingly engages the smooth portion of the nozzle when the bottles are screwed into communication position.

6. An assembly according to claim 1 in which said stopper has an inverted cap shape and comprises a dome, a narrow cylindrical skirt wall extending from said dome and carrying said engagement means, and a narrow annular collar which extends beyond said opening in all directions to overlay a portion of said annular base wall.

7. An assembly according to claim 1 in which the undersurface of said stopper is provided with a projection which extends within said nozzle and adjacent the interior surface thereof, said projection being engagable by the rim of the neck of said second bottle when the latter is screwed into communication position to pivot said stopper out of sealing engagement within said opening.

8. An assembly according to claim 1 in which said stopper comprises a soft, flexible polymer material.

9. An assembly according to claim 1 in which said first bottle is molded of flexible polymer composition and said cylindrical skirt element is molded of rigid polymer composition.

10. An assembly according to claim 9 in which said first bottle is molded of flexible polyethylene and said skirt element is molded of rigid polypropylene to form said engagement means and interior screw thread integral with said nozzle.

* * * * *